US005295906A

United States Patent [19]

Skees

[11] Patent Number: 5,295,906

[45] Date of Patent: Mar. 22, 1994

[54] BUSINESS FORM OR MAILER HAVING AN IMAGABLE SURFACE

[75] Inventor: Hugh B. Skees, Dayton, Ohio

[73] Assignee: The Standard Register Company, Dayton, Ohio

[21] Appl. No.: 880,694

[22] Filed: May 8, 1992

[51] Int. Cl.[5] ..... B41L 1/22

[52] U.S. Cl. ..... 462/18; 462/2; 462/6; 462/55; 462/56

[58] Field of Search ..... 462/2, 5, 6, 8, 55, 462/56

[56] References Cited

U.S. PATENT DOCUMENTS

| | | | |
|---|---|---|---|
| 1,705,407 | 3/1929 | Joffe | 462/55 X |
| 3,419,286 | 12/1968 | Noonan et al. | 282/11.5 |
| 3,663,256 | 5/1972 | Miller et al. | 117/36.2 |
| 3,672,935 | 6/1972 | Miller et al. | 117/36.8 |
| 3,777,971 | 12/1973 | Steidinger | 229/68 R |
| 3,791,572 | 2/1974 | Gendron | 229/69 R |
| 3,825,467 | 7/1974 | Phillips, Jr. | 161/159 |
| 3,830,141 | 8/1974 | Steidinger | 93/63 M |
| 3,988,971 | 11/1976 | Steidinger | 93/63 M |
| 4,081,127 | 3/1978 | Steidinger | 229/69 |
| 4,095,695 | 6/1978 | Steidinger | 206/610 |
| 4,172,605 | 10/1979 | Welsch et al. | 282/27.5 |
| 4,248,919 | 2/1981 | Davis | 462/55 X |
| 4,406,816 | 9/1983 | Sliwka | 521/69 |
| 4,425,386 | 1/1984 | Chang | 427/256 |
| 4,496,961 | 1/1985 | Devrient | 346/206 |
| 4,596,996 | 6/1986 | Sandberg et al. | 346/207 |
| 4,614,362 | 9/1986 | Breen et al. | 462/56 |
| 4,636,818 | 1/1987 | Jerabek | 346/213 |
| 4,705,298 | 11/1987 | Van Malderghem et al. A | 282/11.5 |
| 4,706,877 | 11/1987 | Jenkins | 229/73 |
| 4,726,970 | 2/1988 | Morrish et al. | 462/6 X |
| 4,729,506 | 3/1988 | Neubauer | 229/69 |
| 4,770,337 | 9/1988 | Leibe | 229/69 |
| 4,877,177 | 10/1989 | Felix | 229/92.3 |
| 5,024,374 | 6/1991 | Ashby | 229/71 |
| 5,047,384 | 9/1991 | McCormick | 503/226 |
| 5,062,570 | 11/1991 | Ashby | 462/6 X |
| 5,076,489 | 12/1991 | Steidinger | 229/71 |
| 5,088,961 | 2/1992 | Sprain | 462/2 |

*Primary Examiner*—Paul A. Bell

*Attorney, Agent, or Firm*—Killworth, Gottman, Hagan & Schaeff

[57] ABSTRACT

A mailer or business form is provided including a coating of a first colorless reactant on one sheet thereof and a transparent patch overlying the coating. The surface of the patch facing the sheet includes a coating of a second colorless reactant such that when the transparent patch is impacted by an imaging force, a visible image is formed which may be viewed.

17 Claims, 3 Drawing Sheets

BUSINESS FORM OR MAILER HAVING AN IMAGABLE SURFACE

BACKGROUND OF THE INVENTION

The present invention relates to a mailer or business form having an imagable surface, and more particularly, to a mailer or business form including a coating of a first colorless reactant on one surface thereof and a transparent patch overlying the coating, the patch including a coating of a second colorless reactant on the surface facing the first coating such that when the transparent patch is impacted by an imaging force, a visible image is formed.

Mailers or business form assemblies typically comprise sealed envelopes which contain additional sheets therein on which information can be printed by impact printing processes. These mailers are frequently processed by computer-aided automated systems. The ability to print information selectively both on the inside and on the outside of the mailer simultaneously eliminates time-consuming separate printing of the sheets and envelopes, and manual stuffing, sealing, and stamping of individual envelopes. Mailers of this type are described in U.S. Pat. Nos. 3,777,971, 3,830,141, 3,988,971, 4,081,127, 4,095,965, 4,425,386, 4,705,298 and 4,729,506.

In producing this type of mailer or business form, confidential information, such as billing information, appears only on the inner layers of the mailer, while other information, such as the address, must appear on the outside. A number of techniques have been proposed to accomplish this result.

One prior method involves printing all of the information on the outside of the mailer and onto one or more interior sheets. The confidential information, which is to appear only on the inner layers, is then obscured by overprinting the confidential information on the exterior surface of the mailer with enough printed characters to make it unreadable. However, envelopes printed in this fashion have an undesirable appearance and require additional printing steps.

Another prior method involves the use of spot coatings of carbon ink on the bottom side of a top record sheet positioned over the mailer. Using this method, the address information can be printed on the front of the envelope by positioning it under the carbon spot, while confidential information can be printed onto the interior sheets. However, this system requires the use of expensive carbonizing bond paper to prevent penetration of the carbon ink. In addition, the top record sheet is typically thrown away because the information recorded there is usually stored on computer.

Another type of mailer uses a carbon ink spot coated carbon tissue which is placed between the top sheet and the mailer. This eliminates the use of expensive carbonizing bond paper, but the carbon tissue must be removed and thrown away prior to mailing.

Carbon ink spot coated carbonizing bond paper and carbon tissue sheets have sometimes been used inside the mailer. However, as discussed previously, these systems are expensive and, in addition, can cause smudging of the image receiving sheet.

Another system is disclosed in U.S. Pat. No. 4,172,605 which uses a chemically reactive ribbon for a typewriter or a computer printer. The ribbon is coated with a solution which reacts with the coating on portions of the mailer to form images. However, this system requires direct contact between the ribbon and the mailer so that the chemical reaction can take place. In addition, the ribbons, which are relatively expensive, must be replaced frequently.

Still another system is disclosed in Chang et al, U.S. Pat. No. 4,425,386. The mailer uses an autogenous, or self-contained, carbonless coating over part of the top sheet. The impact of the printer or typewriter causes the image to develop in the coated area. Other information printed at the same time but outside the coated area will not appear on the top sheet. The interior sheets of the mailer may have self-contained coatings or other printing systems so that the other information will appear on the appropriate sheets.

While the mailer described in the Chang patent solves some of the problems associated with mailers, it suffers some serious drawbacks. The Chang patent teaches the use of a typical self-contained coating, which contains an encapsulated color former dissolved in oil and a dispersed color developer, such as phenolic resin or acid clay. However, such self-contained coatings suffer from a number of disadvantages. One problem with typical self-contained coatings is that dispersions of color developer usually must be applied as low solids content dispersions due to the poor rheology (i.e., high viscosity) of commercially available phenolic dispersions. The low solids level results in higher drying requirements, weak image development, and sheet distortion upon drying. Poor rheology also limits the method of applying these coatings by air knives or other full coat applicators, effectively preventing their use as spot coatings. In some cases, the addition of high levels of binder to the coating may permit it to be printed as a spot coating, but this results in poor image development.

Background coloration is also a major problem with conventional self-contained coatings. The existence of free color former in the coating remaining after the encapsulation process causes premature coloration of the background when it reacts with the dispersed color developer which is also present. Additional background coloration can be caused by the tendency of phenolic resin dispersions to yellow when exposed to air. Premature coloration of the color former microcapsules may also result due to their rupture by pressures such as minor abrasions and friction applied to the paper during storage, transportation and routine handling.

Another problem with typical self-contained coatings is the waste of expensive color forming dyes. Much of the dissolved dye remains in the capsules and is not available for reaction with the color developer when the capsules are ruptured. This requires the use of higher coating weights to achieve a sufficient surface concentration of dye and results in a significant waste of dye.

Van Malderghem, U.S. Pat. No. 4,705,298 discloses a self-imaging web including a coating containing dye microcapsules and an acidic co-reactant positioned behind the window cut area of an envelope face web such that when the self-imaging web is impacted, address information may be viewed through the window area. However, additional steps are required to provide die cut windows on the envelope. In addition, a separate continuous web is required to form window patches over the die cut windows.

Neubauer, U.S. Pat. No. 4,729,506, teaches yet another variation of carbonless coatings in which a continuous mailer assembly is provided comprising a front ply having a cut-out window, a transparent patch secured over the window, an insert ply and a back ply. The patch is provided with a CB coating on its under surface while the upper surface of the uppermost insert ply is provided with a CF coating such that when pressure is applied to the patch, the CB coating reacts with the CF coating to form an image on the mailer which can be viewed through the patch. However, the mailer construction requires both a separate coated insert ply and front ply including a cut-out window and patch.

Accordingly, there is still a need in the art for a mailer or business form having an imagable area which allows information to be printed and viewed without the need for die cut windows, additional webs or plies, and without the drawbacks of self-contained coatings

SUMMARY OF THE INVENTION

The present invention meets that need by providing a mailer or business form having a transparent patch overlying an imagable exterior surface of the mailer which allows address or other information to be easily printed by automated systems so that it may be viewed through the transparent patch. The transparent patch provides an effective protective layer over the imagable surface of the mailer or business form to prevent the undesirable premature coloration problems found in prior art self-contained carbonless coating systems.

By transparent, it is meant that the patch should meet U.S. Postal Service specifications for reflectance (sufficient transparency to read the printing beneath the transparent patch) and PCS ("Print Contrast Signal'-'—sufficient contrast between the printing and background beneath the transparent patch); and should have sufficient resistance to ultraviolet radiation such that it does not yellow or lose its transparency over time. Thus, the term transparent, as used in this specification, also encompasses translucent materials to the extent that they meet the above-mentioned specifications.

In accordance with one aspect of the present invention, a mailer or business form is provided which comprises at least one exterior sheet having first and second major surfaces. The first surface of the sheet includes a coating of a first colorless reactant, which, when combined with a second colorless reactant at a later time, reacts to form a colored composition which yields a visible image.

A transparent patch is also provided which overlies at least a portion of the first colorless reactant coated on the sheet. The transparent patch preferably comprises a polymeric film which is secured along its peripheral edges to the sheet by glue or other adhesive. The surface of the transparent patch facing the sheet includes a coating of a second colorless reactant. The first and second reactants are adapted to be combined upon the impact of an imaging force, such as an impact printer using no ribbon or an uninked ribbon, on the transparent patch to form a visible image which is viewable through the transparent patch. Alternatively, the transparent patch may be removed after imaging on the surface of the sheet.

In a variation of this embodiment, the transparent patch may be adhered to the sheet by an adhesive which covers the entire surface of the patch facing the sheet. In this embodiment, the second colorless reactant may either underlie or overlie the adhesive as long as the adhesive is exposed at two or more edges on the sheet for sufficient adhesion.

In a preferred embodiment of the invention, the first colorless reactant comprises a color former (CB coating), and the second colorless reactant comprises a color developer (CF coating). In an alternative embodiment of the invention, the first colorless reactant comprises a color developer and the second colorless reactant comprises a color former.

In an alternative embodiment of the invention, the mailer or business form includes a second sheet underlying the first sheet, where the first sheet forms an envelope front and the second sheet forms an envelope back, with the peripheral edges of the sheets secured together. In this embodiment, the lower surface of the first sheet includes a coating of the second colorless reactant and the upper surface of the second sheet facing the first sheet is coated with the first colorless reactant. Thus, when the transparent patch is impacted, a visible image is formed on both the first and second sheets. As is known in the art, the location of the imaging coatings on the sheets may be such that application of an imaging force produces an image on one or both sheets. In a further variation, the imaging coating on the facing surface of the second sheet may be a self-contained carbonless coating.

In another variation of this embodiment, the mailer or business form also includes at least one intermediate sheet interposed between the first and second sheets. Preferably, the lower surface of the first sheet includes a coating of the second colorless reactant, the intermediate sheet includes a coating of the first colorless reactant on its upper surface and a coating of the second colorless reactant on its lower surface, and the upper surface of the second sheet includes a coating of the first colorless reactant such that the impact of an imaging force on the transparent patch forms a visible image on each of the first, intermediate, and second sheets. Again, as is known in the art, the imaging coatings may be located so that application of an imaging force produces an image on one, two, or all sheets. Likewise, the imaging coatings on the interior facing surfaces of the sheets may be self-contained carbonless coatings.

In an alternative embodiment of the invention, the mailer or business form comprises at least one exterior sheet having first and second major surfaces and a transparent patch overlying at least a portion of the first surface of the sheet. The surface of said transparent patch facing the sheet includes a self-contained carbonless coating of a first substantially colorless reactant and a second substantially colorless reactant, which, when combined, form a colored composition which yields a visible image. At least one of the first and second reactants are contained in a plurality of capsules which rupture upon the application of an imaging force on the transparent patch to form a visible image on the patch surface which is viewable through the transparent patch. Some of the colored imaging material may be transferred to the first surface where it serves to enhance the visibility of the image.

In yet another alternative embodiment of the invention, the mailer or business form comprises at least one exterior sheet having first and second major surfaces and a transparent patch overlying at least a portion of the sheet. The surface of the transparent patch facing the sheet includes a coating comprising solvent soluble, water insoluble dye particles and an encapsulated solvent. The encapsulated solvent is adapted to dissolve the dye particles upon the impact of an imaging force on the transparent patch to form a visible image which is viewable through the transparent patch. The dye particles preferably have a diameter of between about 0.3–50 μm. Suitable dyes for use include the class of solvent dyes as described in the American Textile Colorists and Chemists Color Index. The coating preferably includes a binder, and optionally, an opacifier.

The present invention thus provides a mailer or business form having a plurality or multiplicity of plies which eliminates the need for a cut out window or a self-contained carbonless coating on the top surface of the mailer as required by the prior art. In addition, the transparent patch provides protection to the images formed during processing and handling of the mailer. Accordingly, it is an object of the present invention to provide a mailer or business form including a first colorless reactant and a transparent patch overlying the coating which includes a second colorless reactant such that when the transparent patch is impacted by an imaging force, a visible image is formed which may be viewed through the patch. This, and other objects and advantages of the present invention will become apparent from the following detailed description, the accompanying drawings, and the appended claims.

DETAILED DESCRIPTION OF THE PREFERRED EMBODIMENTS

Figure 1:
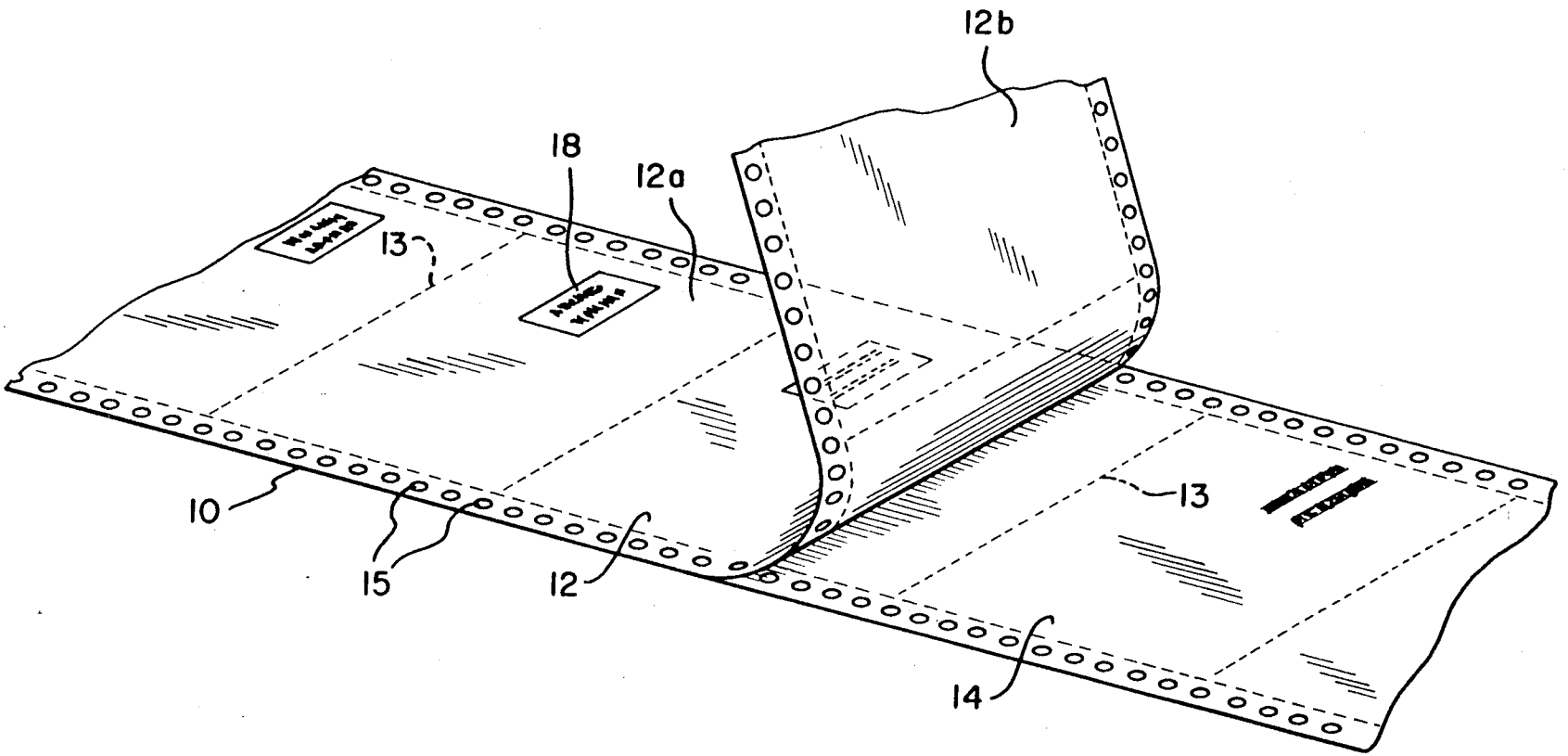
FIG. 1 is a perspective view of a continuous mailer or business form in accordance with the present invention.

Referring to FIG. 1, there is shown a continuous mailer or business form 10 comprising a first sheet 12 having first and second major surfaces 12*a* and 12*b*, respectively. It will be appreciated that a preferred manufacturing procedure involves making the form or mailer from a continuous web in which individual forms may then be separated along perforations 13. Also, the continuous web may contain prepunched holes 15 to guide the web through an automated printer.

The mailer or business form of the present invention may also be manufactured by assembly and stacking of individual sheets. The mailer or business form may also include a second sheet 14, where the first sheet 12 is an envelope front and the second sheet 14 is an envelope back and the peripheral edges of the sheets are secured together. Also as shown in FIG. 1, a transparent patch 18 is secured to first sheet 12. Preferably, the transparent patch is secured along its peripheral edges to the first sheet by glue or other adhesive, and comprises a substantially transparent polymeric film such as polyester, polystyrene, polyethylene, polypropylene or cellulose acetate. Patch 18 provides mechanical protection against inadvertent premature breakage of the colorless reactant capsules carried on its underside.

Figure 3:
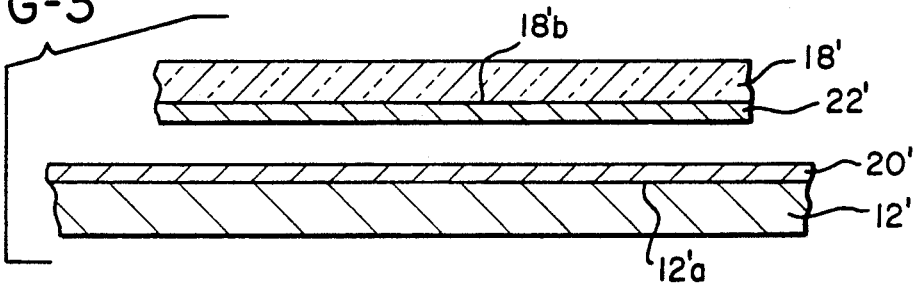
FIG. 3 is a fragmentary sectional view of another embodiment of the invention.

FIG. 3 illustrates a sectional view of the mailer or business form in which the upper surface 12'*a* of sheet 12 includes a coating of a first substantially colorless reactant 20'. The coating may be spot coated in the area directly below transparent patch 18', or alternatively, it may cover the entire surface of the sheet. Transparent patch 18 preferably overlies at a least a portion of the first substantially colorless reactant on the sheet and includes a coating of a second substantially colorless reactant 22' on its lower surface 18*b*. When an imaging force impacts the transparent patch, the first colorless reactant 20' combines with second colorless reactant 22' to form a visible image on sheet 12 which may be viewed through transparent patch 18. The coating carried on the underside of patch 18' is sufficiently transparent so that the visible image can be seen. If desired after imaging, the transparent patch 18 may be left intact or peeled off of sheet 12'. Removal of patch 18 provides the additional advantage of removing the coating on its underside, thus preventing the formation of smudges or other stray marks on the newly-imaged sheet 12'.

The transparent patch may be adhered to the sheet in a number of ways. The patch may be coated with a pressure sensitive adhesive and then spot coated with a CB or self-contained coating such that the patch includes an imaging area surrounded by a tacky edge of pressure sensitive adhesive. Alternatively, the CB or self-contained coating may be applied to the patch, followed by a coating of adhesive such that the entire patch surface adheres to the sheet. The patch should be sufficiently secured to the sheet so that jamming of postal sorting equipment is avoided.

In one embodiment of the invention, the first substantially colorless reactant comprises a color developer and the second substantially colorless reactant comprises a color former. In a preferred embodiment of the invention, the first substantially colorless reactant comprises a color former and the second substantially colorless reactant comprises a color developer. This preferred embodiment provides slightly improved legibility of the image formed because the imaging dye develops within the coating on the underside 18'*b* of the transparent patch 18 rather than on the surface of the sheet.

Suitable color developers include phenolic-type resins such as acetylated phenolic resins, salicylic acid modified phenolics, and novolac type phenolic resins. Even more preferred for use is a high solids color developer-containing (CF) printing ink which includes water, a non-volatile diluent, and an acidic color developer. The ink preferably has a 50–70% by weight solids content. See U.S. Pat. No. 5,084,492, the disclosure of which is hereby incorporated by reference.

Well known color formers include those initially colorless chromogenic dye precursors such as Crystal Violet Lactone, 4,4'-bis(diethylamino)benzhydrol, Benzoyl Leuco Methylene Blue, Indolyl Red, Malachite Green Lactone, 8-methoxybenzoindoline spiropyran, and Rhodamine Lactone. Even more preferred is a high solids content, aqueous, microcapsule-containing (CB) printing ink which is prepared by an interfacial polymerization or crosslinking in which a crosslinking agent such as a polyisocyanate is dissolved in an oily solution which serves as the internal phase of the microcapsules. The oily solution contains an oily solvent and a dye precursor capable of reacting with a color developer to form a color. Preferably, the ink has a solids content in the range of approximately 60–70% by weight See U.S. Pat. No. 4,940,739, the disclosure of which is incorporated herein by reference.

The color developer and color former coatings may be printed or coated onto the mailer or business form by a number of conventional techniques including flexographic, gravure and screen printing. The coatings are preferably applied at coating weights of between about 0.20 and 1.5 lbs. per ream (17×22×500).

Figure 2:
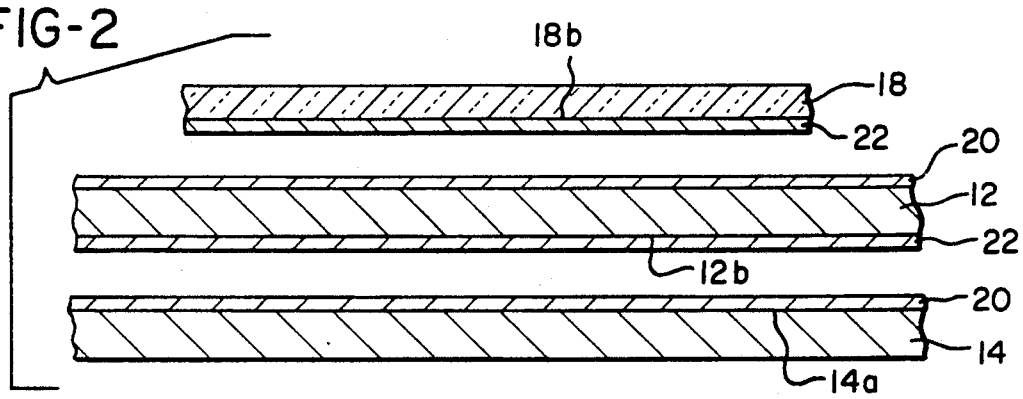
FIG. 2 is a fragmentary sectional view the embodiment shown in FIG. 1.

FIG. 2 illustrates a sectional view of the mailer or business form shown in FIG. 1 which includes transparent patch 18, first sheet 12, and second sheet 14. The lower surface 12*b* of first sheet 12 includes a coating of the second substantially colorless reactant 22. Second sheet 14 includes a coating of the first substantially colorless reactant 20 on its upper surface 14*a*. When an imaging force impacts the transparent patch 18, the first and second reactants combine to form a visible image on the first sheet 12 which is viewable through the transparent patch, and the same image is also formed on the second sheet 14.

Figure 6:
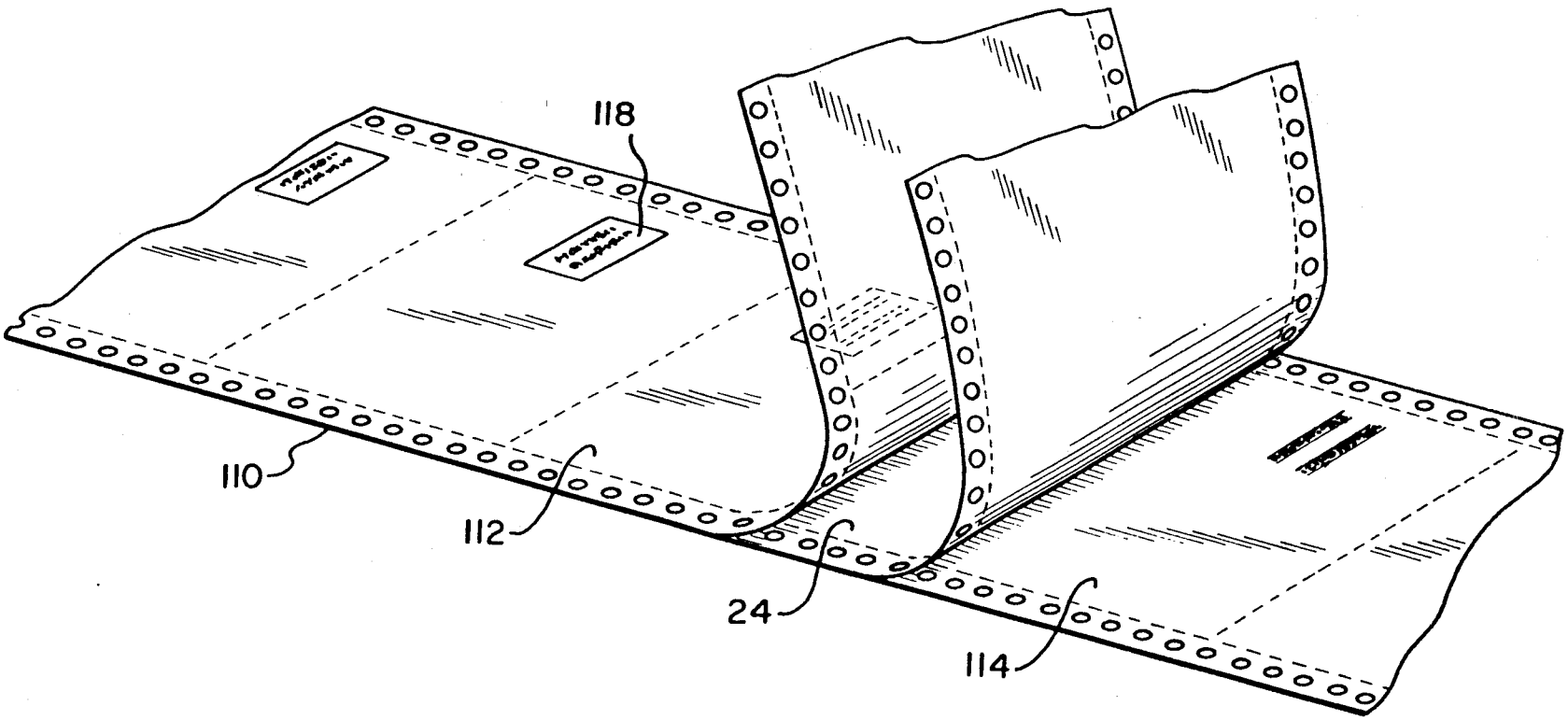
FIG. 6 is a perspective view of a continuous mailer illustrating another embodiment of the invention.

As illustrated in FIG. 6, the mailer or business form 10 may further include at least one intermediate sheet 24 interposed between the first sheet 112 and the second sheet 114. In this embodiment, shown in FIG. 6, the first sheet 112 includes a coating of the second substantially colorless reactant on its lower surface, the intermediate sheet 24 includes a coating of the first substantially colorless reactant on its upper surface and a coating of the second substantially colorless reactant on its lower surface, and the second sheet 114 includes a coating of the first substantially colorless reactant on its upper surface such that the impact of an imaging force on the transparent patch 18 forms a visible image on each of the first, intermediate, and second sheets.

As will be apparent to those skilled in the art, the location of the imaging coatings on the interior-facing surfaces of the sheets may be arranged so that application of an imaging force produces an image on one or more of those sheets. Further, the CF and CB coatings on the interior surfaces of the sheets may be replaced by a self-contained carbonless coating or by carbon paper.

Figure 5:
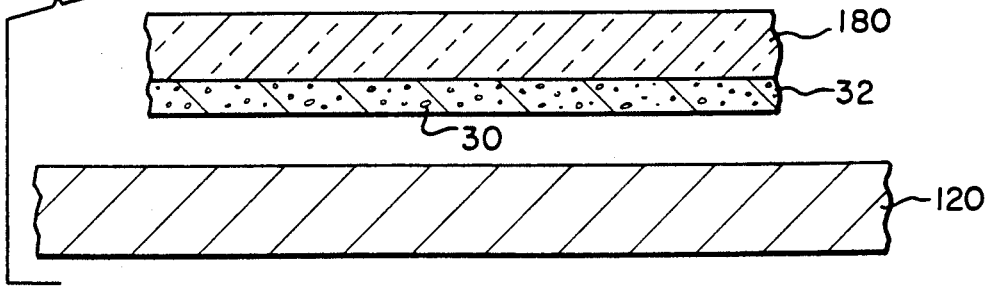
FIG. 5 is a fragmentary sectional view of another embodiment of the invention.

In an alternative embodiment of the invention illustrated in FIG. 5, the lower surface of the transparent patch 180 facing sheet 120 includes a self-contained carbonless coating of a first substantially colorless reactant and a second substantially colorless reactant, at least one of which is encapsulated. In the embodiment shown in FIG. 5, the first colorless reactant is contained in a plurality of microcapsules 30. Upon the impact of an imaging force on the transparent patch, the microcapsules rupture and combine with the second colorless reactant 32 to form a visible image which is viewable through the transparent patch.

Figure 4:
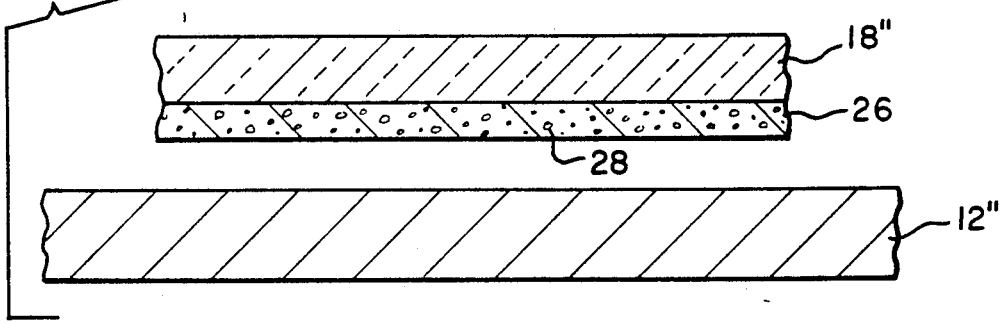
FIG. 4 is a fragmentary sectional view of another embodiment of the invention.

Another alternative embodiment of the invention is illustrated in FIG. 4 in which the lower surface of the transparent patch 18" facing sheet 12" includes a coating comprising solvent soluble, water insoluble dye particles 26 and an encapsulated solvent 28. The encapsulated solvent is adapted to dissolve the dye particles upon the impact of an imaging force on the transparent patch to form a visible image which is viewable through the transparent patch. The dye particles preferably have a diameter of between about 0.3–50 μm. Because the dye particles are relatively large, they are inefficient pigments and have little color. Therefore, the coating may be used without the premature coloration problems of prior art self-contained carbonless coatings.

The coating may be printed or coated onto the transparent patch by a number of conventional techniques including flexography, direct gravure, and screen for applying images, and such methods as blade and reverse roll for continuous coating. The coating is preferably applied to the transparent patch at a coating weight of between about 0.20 and 1.5 lbs. per ream (17×22×500).

Suitable dyes for use include the class of solvent dyes as described in the American Textile Colorists and Chemists Color Index. In addition, the coating preferably includes a binder, and optionally, an opacifier. See copending U.S. application Ser. No. 652,614, filed Feb. 8, 1991, and entitled Solvent and/or Pressure Sensitive Security Document, the disclosure of which is incorporated herein by reference.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A mailer or business form comprising, at least one exterior sheet having first and second major surfaces, a transparent patch overlying at least a portion of said first surface of said sheet, the surface of said transparent patch facing said sheet including a coating comprising solvent soluble, water insoluble dye particles and an encapsulated solvent; said encapsulated solvent adapted to dissolve said dye particles upon the impact of an imaging force on said transparent patch to form a visible image within said coating which is viewable through said transparent patch.

2. The mailer or business form of claim 1 wherein said transparent patch comprises a polymeric film.

3. The mailer or business form of claim 1 wherein said transparent patch is secured to said sheet by an adhesive.

4. A mailer or business form comprising, at least one exterior sheet having first and second major surfaces, said first surface of said sheet including a coating of a first substantially colorless reactant on at least a portion thereof which, when combined with a second substantially colorless reactant at a later time, reacts to form a colored composition which yields a visible image; and a transparent patch overlying at least a portion of said first colorless reactant on said first surface of said sheet, the surface of said transparent patch facing said sheet including said second colorless reactant coated thereon; said first and second reactants adapted to be combined upon the impact of an imaging force on said transparent patch to form said visible image on said first surface which is viewable through said transparent patch.

5. The mailer or business form of claim 4 wherein said transparent patch comprises a polymeric film.

6. The mailer or business form of claim 4 wherein said transparent patch is secured along its peripheral edges to said sheet.

7. The mailer or business form of claim 4 wherein said first substantially colorless reactant comprises a color developer and said second substantially colorless reactant comprises a color former.

8. The mailer or business form of claim 4 wherein said first substantially colorless reactant comprises a color former and said second substantially colorless reactant comprises a color developer.

9. The mailer or business form of claim 4 further including a second sheet underlying said first sheet, wherein said first sheet forms an envelope front, said second sheet forms an envelope back, and the peripheral edges of said sheets are secured together.

10. The mailer or business form of claim 9 wherein said second surface of said first sheet includes said second substantially colorless reactant and the surface of said second sheet facing said first sheet includes said first substantially colorless reactant, such that the impact of an imaging force on said transparent patch forms said visible image on both said first and second sheets.

11. The mailer or business form of claim 9 including at least one intermediate sheet interposed between said first and second sheets.

12. The mailer or business form of claim 11 wherein said second surface of said first sheet includes a coating of said second substantially colorless reactant, said intermediate sheet includes a coating of said first substantially colorless reactant on the upper surface facing said first sheet and a coating of said second substantially colorless reactant on the surface facing said second sheet, and the surface of said second sheet facing said intermediate sheet includes a coating of said first substantially colorless reactant, such that the impact of an imaging force on said transparent patch forms said visible image on each of said first, intermediate, and second sheets.

13. A mailer or business form comprising, at least one exterior sheet having first and second major surfaces, a transparent patch overlying at least a portion of said first surface of said sheet, the surface of said transparent patch facing said sheet including a coating of a first substantially colorless reactant and a second substantially colorless reactant, which, when combined, form a colored composition which yields a visible image, at least one of said first and second reactants being contained in a plurality of microcapsules which rupture upon the application of an imaging force on said transparent patch to form said visible image within said coating which is viewable through said transparent patch.

14. The mailer or business form of claim 13 wherein said transparent patch comprises a polymeric film.

15. The mailer or business form of claim 13 wherein said transparent patch is secured to said sheet by an adhesive.

16. The mailer or business form of claim 13 wherein said first substantially colorless reactant comprises a color developer and said second substantially colorless reactant comprises a color former.

17. The mailer or business form of claim 13 wherein said first substantially colorless reactant comprises a color former and said second substantially colorless reactant comprises a color developer.

* * * * *